United States Patent [19]

Manaka et al.

[11] Patent Number: 4,665,877

[45] Date of Patent: May 19, 1987

[54] AUTOMOBILE FUEL FEED APPARATUS

[75] Inventors: Toshio Manaka; Takeshi Atago; Teruo Yamauchi, all of Katsuta, Japan

[73] Assignee: Hitachi, Ltd., Tokyo, Japan

[21] Appl. No.: 789,020

[22] Filed: Oct. 18, 1985

[30] Foreign Application Priority Data

Oct. 19, 1984 [JP] Japan ..... 59-218401

[51] Int. Cl.[4] ..... F02B 51/00

[52] U.S. Cl. ..... 123/472; 123/478; 123/590; 261/DIG. 48

[58] Field of Search ..... 123/590, 472, 478; 261/78 R, DIG. 48

[56] References Cited

U.S. PATENT DOCUMENTS

| | | | |
|---|---|---|---|
| 4,105,004 | 8/1978 | Asai et al. | 123/590 |
| 4,167,158 | 9/1979 | Martin et al. | 123/590 |
| 4,237,836 | 12/1980 | Tanasawa et al. | 261/DIG. 48 |
| 4,563,993 | 1/1986 | Yamauchi et al. | 261/DIG. 48 |

FOREIGN PATENT DOCUMENTS 58-195064 11/1983 Japan .

*Primary Examiner*—E. Rollins Cross

*Attorney, Agent, or Firm*—Antonelli, Terry & Wands

[57] ABSTRACT

A tubular trembler supported on an ultrasonic vibrator is disposed almost on an axis in an engine intake pipe and has a fuel passing-through hole in the wall thereof. A fuel jet tip of the electromagnetic injection valve is disposed so as to face the fuel passing-through hole so as to jet the fuel divergently against an inside wall of the tubular trembler through the fuel passing-through hole. The fuel is injected against the inside wall of the trembler through the fuel passing-through hole and is atomized. When the fuel is jetted into the fuel passing-through hole from the fuel jet tip, the relative distance from the fuel jet tip to the inside edge of the fuel passing-through hole is determined so that most of the injected fuel will strike the inner wall of the tubular trembler, within the dimensions determined by the bore, the fuel passing-through hole, the inside diameter and the length of the tubular trembler and the angle of the spread of the injected fuel.

3 Claims, 6 Drawing Figures

AUTOMOBILE FUEL FEED APPARATUS

BACKGROUND OF THE INVENTION

1. [Field of the Invention]

The present invention relates to an automobile fuel feed apparatus, and more particularly to an automobile fuel feed apparatus whereby fuel is fed particularly through atomization effected by ultrasonic vibration.

2. [Description of the Prior Art]

An automobile fuel feed apparatus for feeding fuel through an atomization effected by ultrasonic vibration is disclosed in the Japanese Patent Laid-Open Publication No. 195064/1983.

In the above Japanese Patent Laid-Open Publication the automobile fuel feed apparatus comprises an electromagnetic injection valve and an ultrasonic vibrator having a tubular trembler. The electromagnetic injection valve and the ultrasonic vibrator are disposed together within an engine intake pipe at the same side of the engine intake pipe. The tubular trembler of the ultrasonic vibrator vibrates with a characteristic resonant frequency.

The axis of the tubular trembler vibrating with a characteristic resonant frequency and the axis of the electromagnetic injection valve are kept coincident with each other. The axis of the tubular trembler of the ultrasonic vibrator is not coincident with the axis of the engine intake pipe. So the injecting direction of the fuel is also not coincident with the axis of the engine intake pipe. Consequently, the atomized fuel is not spread uniformly within the engine intake pipe.

In the above-described prior art, the fuel is not atomized efficiently because of the arrangement of the tubular trembler, namely the axis of the tubular trembler and the axis of the electromagnetic injection valve are kept coincident with each other.

Furthermore, in the above-described prior art the construction of fuel piping for disposing the electromagnetic injection valve and the structure for fixing the electromagnetic injection valve are unavoidably complicated because of the one side arrangement of the electromagnetic injection valve and the ultrasonic vibrator including the tubular trembler.

SUMMARY OF THE INVENTION

An object of the present invention is to provide an automobile fuel feed apparatus wherein fuel can be atomized efficiently in an engine intake pipe.

Another object of the present invention is to provide an automobile fuel feed apparatus wherein fuel can be atomized uniformly in an engine intake pipe.

A further object of the present invention is to provide an automobile fuel feed apparatus wherein an electromagnetic injection vavle and an ultrasonic vibrator can be disposed separately within an engine intake pipe.

A still further object of the present invention is to provide an automobile fuel feed apparatus wherein fuel can be jetted against an inner wall of a tubular trembler of an ultrasonic vibrator.

Still another object of the present invention is to provide an automobile fuel feed apparatus wherein the construction of the fuel piping for disposing an electromagnetic injection valve can be simplified.

Yet another object of the present invention is to provide an automobile fuel feed apparatus wherein the structure for fixing the electromagnetic injection valve can be simplified.

The objects of the present invention are accomplished in an automobile fuel feed apparatus comprising: an electromagnetic injection valve mounted on an engine intake pipe for injecting a measured amount of fuel; an ultrasonic vibrator disposed in the engine intake pipe and supported on the wall of the engine intake pipe; and a tubular trembler vibrating with a characteristic resonant frequency held on the ultrasonic vibrator and disposed in the engine intake pipe for atomizing the fuel therein, characterized in that the tubular trembler is disposed almost on an axis in the engine intake pipe; a fuel passing-through hole is formed in a wall of the tubular trembler and is opened at an axial intermediate portion of the engine intake pipe; and a fuel jet tip of the electromagnetic injection valve is disposed oppositely to the fuel passing-through hole outside of said tubular trembler so as to jet the fuel divergently against an inside wall of the tubular trembler through the fuel passing-through hole of the tubular trembler.

The fuel passing-through hole is provided on a side wall of the tubular trembler vibrating with a characteristic resonant frequency, so that the fuel is jetted against an inner wall of the tubular trembler through the fuel passing-through hole to effect atomization.

Further, when the fuel is jetted into the fuel passing-through hole of the tubular trembler from the fuel jet tip of the electromagnetic injection valve, the relative distance from the fuel jet tip to the fuel passing-through hole inside wall of the tubular trembler is determined so that most of the injected fuel will strike the inner wall of the tubular trembler, within the dimensions determined by the bore of the fuel passing-through hole, the inside diameter and length of the tubular trembler and the angle of spread the injected fuel.

Most of the injected fuel can strike the inner wall of the tubular trembler to effect atomization by arranging the distance between the fuel jet tip of the electromagnetic injection valve and the inner wall of the tubular trembler x such that the axial length L of the tubular trembler is $L=2(x+D)\tan(\theta/2)$ when the bore of the fuel passing-through hole is $d>2\times\tan(\theta/2)$, and $d=2\times\tan(\theta/2)$ when $L>2(x+D)\tan(\theta/2)$.

The automobile fuel feed apparatus according to the present invention is effective in atomizing the fuel efficiently and also simplifying structures.

DETAILED DESCRIPTION OF THE PREFERRED EMBODIMENTS

An automobile fuel feed apparatus embodying the present invention will now be described with reference to FIG. 1 to FIG. 4*b*.

Figure 1:
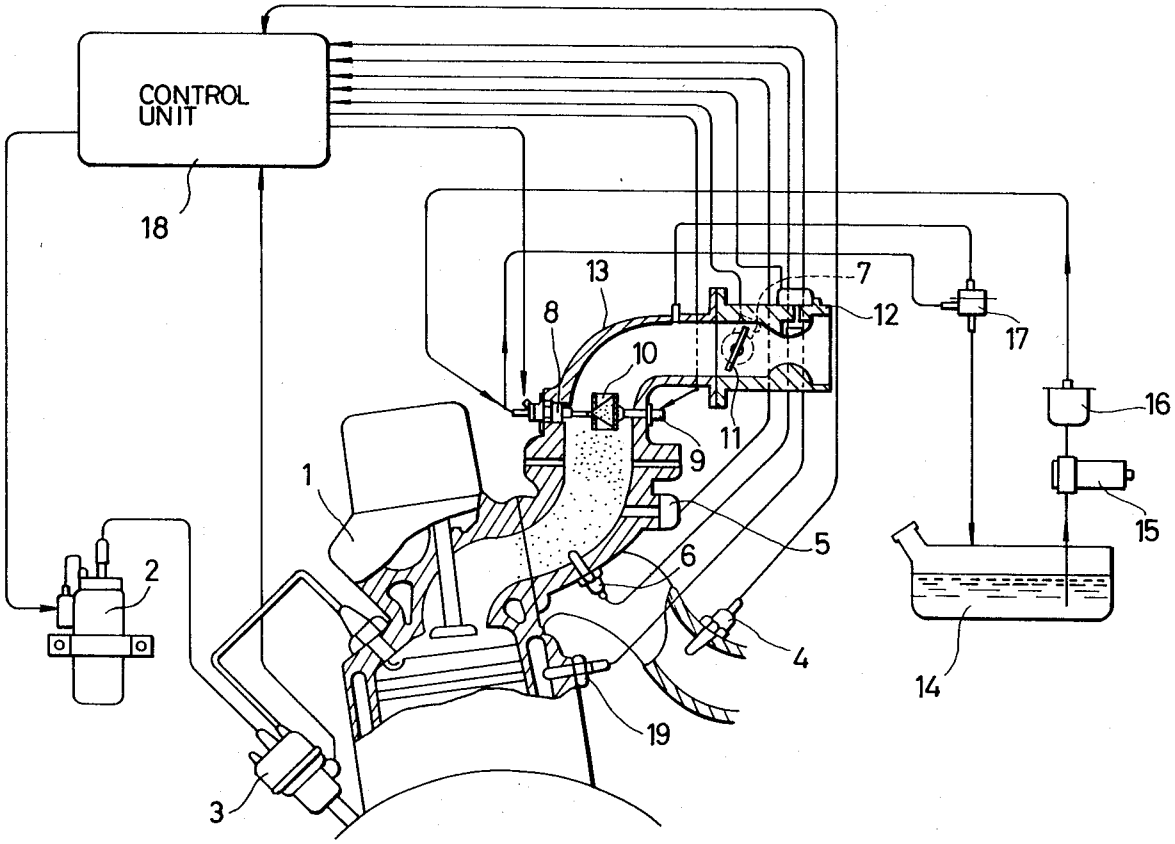
FIG. 1 is a schematic diagram of an engine system of an automobile fuel feed apparatus according to one embodiment of the present invention.

FIG. 1 shows an engine system to which an automobile fuel feed apparatus of the present invention is applied.

An engine 1 has an engine intake pipe 13 which is provided with electromagnetic injection valves (injectors) 8 corresponding to the number of cylinders. The electromagnetic injection valve 8 is mounted upstream or downstream from a throttle valve 11 and operates to inject a measured amount of fuel. This engine intake pipe 13 is brought into a single pipe at a collector in the upstream side, and has the throttle valve 11 for determining the amount of air intake for the engine 1 further upstream.

The engine 1 has an intake pressure sensor 5, an intake temperature sensor 6, an air flow sensor 12, and a throttle opening sensor 7 in the engine intake pipe 13. An exhaust gas sensor 4 and a water temperature sensor 19 are provided with the engine 1. An ignition coil 2 is connected between a control unit 18 and a rotation sensor 3 with a built-in distributor.

The amount of air intake for the engine 1 is measured by the air flow sensor 12 provided still further upstream. Engine revolutions are counted by the rotation sensor 3. Fuel is supplied to the engine 1 by controlling the opening of each of the elctromagnetic injection valves 8, and the amount of fuel is measured based on the valve opening time. Fuel is pressurized and regulated through a fuel pump 15 and a regulator 17.

A cylinder classifying signal, an engine rotational frequency N, an engine cooling water temperature $T_w$, and an intake air quantity Qa detected by the rotation sensor 3, the water temperature sensor 19 and the air flow sensor 12 are input respectively to the control unit 18. An injection signal is output to the electromagnetic injection valve 8 from the control unit 18 according to the above-mentioned input data.

The fuel injection is then carried out synchronously with a rotation signal generated from the rotation sensor 3. Fuel is drawn from the fuel tank 14 by the fuel pump 15 of a fuel system and fed to the electromagnetic injection valve 8 through a filter 16. Fuel pressure is controlled by the regulator 17 so that the difference between the internal pressure of the engine intake pipe 13 and the atmospheric pressure will be constant at all times.

Figure 2:
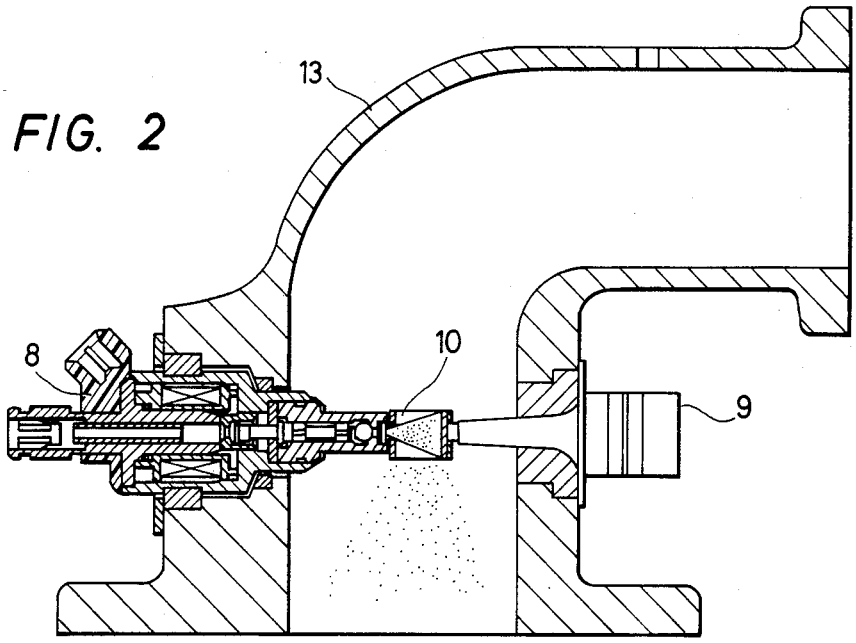
FIG. 2 is an enlarged sectional view of an engine intake pipe provided with an electromagnetic injection valve and an ultrasonic vibrator.

FIG. 2 shows an enlarged sectional view of the engine intake pipe 13 surrounding the electromagnetic injection valve 8 and an ultrasonic vibrator 9 according to one embodiment of the present invention.

The electromagnetic injection valve 8 is disposed opposite to the ultrasonic vibrator 9 and projects into the passage of the engine intake pipe 3. The electromagnetic injection valve 8 and the ultrasonic vibrator 9 are retained separately on the engine intake pipe 13. A tubular trembler 10 is supported on the ultrasonic vibrator 9. The electromagnetic injection valve 8 and the ultrasonic vibrator 9 are disposed respectively substantially orthogonal to the axis of the tubular trembler 10. The tubular trembler 10 is supported concentrically within the engine intake pipe 13.

Figure 3A:
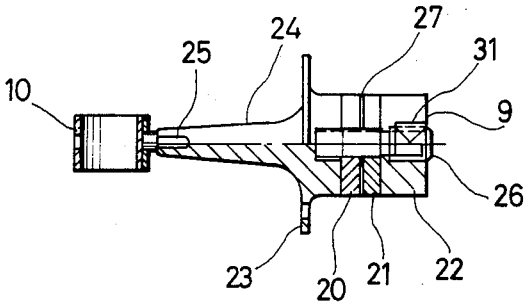
FIG. 3*a* is a front view of an ultrasonic vibrator of the automobile fuel feed apparatus according to one embodiment of the present invention.
Figure 3B:
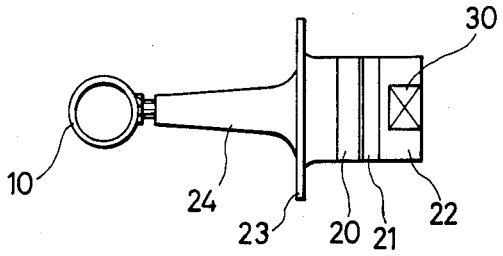
FIG. 3*b* is a top plan view of an ultrasonic vibrator of the automobile fuel feed apparatus according to one embodiment of the present invention.

FIG. 3*a* and FIG. 3*b* show a front view and a top plan view respectively of the ultrasonic vibrator 9 of the automobile fuel feed apparatus.

The tubular trembler 10 provides a fuel passing-through hole 28 on the side wall thereof. The electromagnetic injection valve 8 provides a fuel jet tip or a fuel jet end 29 on the tip or the end thereof. The electromagnetic injection valve 8 is positioned with respect to the ultrasonic vibrator 9 with the fuel jet tip 29 thereof opposite to and spaced from the fuel passing-through hole 28 of the tubular trembler 10 at a position orthogonal to the axis of the tubular trembler 10.

The fuel jet tip 29 of the electromagnetic injection valve 8 jets the fuel divergently against an inside wall of the tubular trembler 10 through the fuel passing-through hole 28 from outside of the tubular trembler 10. The fuel is atomized to about 30 m droplets by the tubular trembler 10 vibrating on the characteristic resonant frequency.

In FIG. 3*a* and FIG. 3*b*, the ultrasonic vibrator 9 comprises two piezo-electric elements 20 and 21, a fixed plate 22, a piezo-electric element compressing screw 26, and an impressed voltage terminal 27. A locking screw 25 connects the tubular 10 with a horn unit 24 of the ultrasonic vibrator 9. The ultrasonic vibrator 9 further comprises a flange unit 23, a wrench-locked surface 30 and a detent 31.

The ultrasonic vibrator 9 has the two piezo-electric elements 20, 21 fixed and formed on the flange unit 23 of the horn unit 24 with the piezo-electric element compressing screw 26. Then, the two piezo-electric elements 20, 21 expand in response to a pulse voltage of 300 to 500 V applied between the impressed voltage terminal 27 and the earth (the flange unit 23), the vibration is transferred to the horn unit 24 formed on a nose of the flange unit 23 and finally transferred to the tubular trembler 10.

Figure 4A:
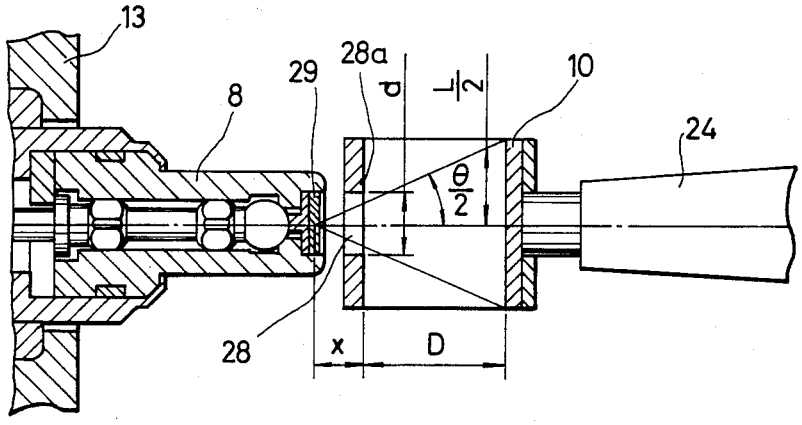
FIG. 4*a* is an explanatory view for a tubular vibrator and an electromagnetic injection valve according to one embodiment of the present invention.
Figure 4B:
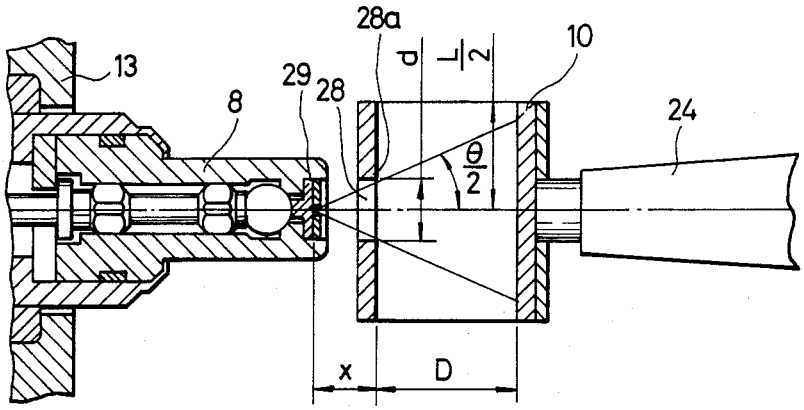
FIG. 4*b* is an another explanatory view for a tubular vibrator and an electromagnetic injection valve according to one embodiment of the present invention.

FIG. 4*a* and FIG. 4*b* are explanatory views showing respectively in detail the dimensions of the mounting portion of the electromagnetic injection valve 8 and the tubular trembler 10 of the ultrasonic vibrator 9.

In FIG. 4*a* and FIG. 4*b* the tubular trembler 10 has an axial length L, an inside diameter D, the fuel passing-through hole 28 of the tubular trembler 10 having a bore d at an axial intermediate portion, and is fixed on the ultrasonic vibrator 9. The fuel jet tip 29 of the electromagnetic injection valve 8 is so formed as to jet the fuel divergently at an angle $\theta$, and the distance between the fuel jet tip 29 of the electromagnetic injection valve 8 and the inner wall or an inside wall corner 28*a* of the tubular trembler 10 at a position of the fuel passing-through hole 28 is x. The distance x will be effective for the fuel jetted at the angle $\theta$ to strike the inner wall surface of the tubular trembler 10 over the widest possible area to effect atomization when the fuel jetted from the fuel jet tip 29 at the angle $\theta$ barely comes in contact with the inside wall corner 28*a* of the fuel passing-through hole 28 of the tubular trembler 10 (see FIG. 4*b*).

If the distance x is smaller than the state described above, the area in which the fuel strikes the inner wall surface of the tubular trembler 10 is reduced to a size that is not adequate for the purpose. Conversely, if the distance x is larger than the state described above, the fuel jetted at the angle $\theta$ strikes a portion larger than the inside wall corner 28*a*, which is also undesirable.

FIG. 4*a* indicates the case where the bore d of the fuel passing-through hole 28 is larger than $2\times\tan(\theta/2)$ and the fuel strikes as far as the axial length L of the tubular trembler 10.

FIG. 4*b* indicates the case where the axial length L of the tubular trembler 10 is larger than $2(x+D)\tan(\theta/2)$, and the electromagnetic injection valve 8 and the tubular trembler 10 are spaced from each other as far as $d=2\times\tan(\theta/2)$.

Then, most of the injected fuel can strike the inner wall of the tubular trembler 10 to effect atomization by arranging the distance x between the fuel jet tip 29 of the electromagnetic injection valve 8 and the inner wall of the tubular trembler 10 such that the axial length L of the tubular trembler 10 is $L=2(x+D)\tan(\theta/2)$ when the bore d of the fuel passing through hole 28 of the tubular trembler 10 is $d>2\times\tan(\theta/2)$ and $d=2\times\tan(\theta/2)$ when $L>2(x+D)\tan(\theta/2)$.

As described above, the automobile fuel feed apparatus embodying the present invention comprises injecting the fuel against the inside wall of the tubular trembler 10 from the fuel passing-through hole 28 on the side wall of the tubular trembler 10 supported on the ultrasonic vibrator 9. Therefore the fuel piping structure and the electromagnetic injection valve 8 attaching structure can be simplified as compared with those of the conventional structure, and the fuel can be atomized efficiently.

What is claimed is:

1. An automobile fuel feed apparatus comprising: an electromagnetic injection valve mounted upstream or downstream from a throttle valve of an engine intake pipe for injecting a measured amount of fuel; an ultrasonic vibrator disposed in the engine intake pipe and supported on the wall of the engine intake pipe; a tubular trembler vibrating at a characteristic resonant frequency and held on said ultrasonic vibrator so as to be disposed in the engine intake pipe for atomizing the fuel therein, said electromagnetic injection valve and said ultrasonic vibrator being disposed substantially orthogonal to the axis of said tubular trembler, and said tubular trembler being disposed almost on the center axis in the engine intake pipe; a fuel passing-through hole formed in a wall of said tubular trembler, said electromagnetic injection valve having a fuel jet tip with a single nozzle disposed outside of said tubular trembler and facing said fuel passing-through hole so as to jet fuel divergently against an inside wall of said tubular trembler through said fuel passing-through hole of said tubular trembler.

2. An automobile fuel feed apparatus as defined in claim 1, wherein a distance x is formed so that $L=2(x+D)\tan(\theta/2)$ at the time of $d>2x\tan(\theta/2)$, where L is the axial length of said tubular trembler, D is the inside diameter of said tubular trembler, d is the bore of said fuel passing-through hole, x is the distance from the fuel jet tip of said electromagnetic injection valve to the inner wall of said tubular trembler at said fuel passing-through hole position, and $\theta$ is the angle of spread of the injected fuel.

3. An automobile fuel feed apparatus as defined in claim 1, wherein a distance x is formed so that $d=2\times\tan(\theta/2)$ at the same time of $L>2(x+D)\tan(\theta/2)$, where L is the axial length of said tubular trembler, D is the inside diameter of said tubular trembler, d is the bore of said fuel passing-through hole, x is the distance from the fuel jet tip of said electromagnetic injection valve to an inner wall of said tubular trembler at said fuel passing-through hole position, and $\theta$ is the angle of spread of the injected fuel.

* * * * *